US010669650B2

(12) United States Patent
King et al.

(10) Patent No.: US 10,669,650 B2
(45) Date of Patent: Jun. 2, 2020

(54) WOVEN GEOSYNTHETIC FABRIC

(71) Applicant: Nicolon Corporation, Pendergrass, GA (US)

(72) Inventors: Kevin Nelson King, Alto, GA (US); David Michael Jones, Dacula, GA (US)

(73) Assignee: NICOLON CORPORATION, Pendergrass, GA (US)

( * ) Notice: Subject to any disclaimer, the term of this patent is extended or adjusted under 35 U.S.C. 154(b) by 123 days.

(21) Appl. No.: 14/090,345

(22) Filed: Nov. 26, 2013

(65) Prior Publication Data

US 2014/0099850 A1 Apr. 10, 2014

Related U.S. Application Data

(63) Continuation of application No. 13/085,293, filed on Apr. 12, 2011, now Pat. No. 8,598,054.

(Continued)

(51) Int. Cl.
*D03D 11/00* (2006.01)
*D03D 15/00* (2006.01)

(52) U.S. Cl.
CPC ..... *D03D 11/00* (2013.01); *D03D 15/00* (2013.01); *D03D 15/0027* (2013.01); *D03D 15/0088* (2013.01); *D03D 15/0094* (2013.01); *D10B 2321/021* (2013.01); *D10B 2321/022* (2013.01); *D10B 2401/041* (2013.01); *D10B 2401/063* (2013.01); *D10B 2505/204* (2013.01);

(Continued)

(58) Field of Classification Search
CPC .. D03D 11/00; D03D 13/004; D03D 15/0088; Y10T 442/3089; Y10T 442/3211
USPC ..... 442/185, 189, 192, 195, 203, 205, 207
See application file for complete search history.

(56) References Cited

U.S. PATENT DOCUMENTS 3,395,198 A 7/1968 Taniguchi et al.
4,460,023 A * 7/1984 Mullaney ..... D21F 1/0036 139/383 A (Continued)

FOREIGN PATENT DOCUMENTS

CN 1708617 A 12/2005
CN 101454393 A 6/2009

(Continued)

OTHER PUBLICATIONS

Chinese Office Action dated Aug. 27, 2013 for Application No. 201180018382.5.

(Continued)

*Primary Examiner* — Andrew T Piziali
(74) *Attorney, Agent, or Firm* — Cantor Colburn LLP

(57) ABSTRACT

A woven geosynthetic fabric is disclosed having a first weft yarn, a second weft yarn, and a stuffer pick woven in the weft direction of the fabric. A warp yarn interweaves the first and second weft yarns and the stuffer pick. The first weft yarn and the second weft yarn having different cross-sectional shapes. At least a portion of the fabric has a plurality of weft yarn sets with stuffer picks respectively disposed and woven between the weft yarn sets. Each weft yarn set has two first weft yarns and two second weft yarns. One of the two first weft yarns is adjacent one of the two second weft yarns and stacked on the other second weft yarn. The adjacent second weft yarn is stacked on the other first weft yarn.

19 Claims, 5 Drawing Sheets

Related U.S. Application Data

(60) Provisional application No. 61/323,341, filed on Apr. 12, 2010.

(52) U.S. Cl.
CPC .... *Y10T 442/3033* (2015.04); *Y10T 442/3065* (2015.04); *Y10T 442/3089* (2015.04); *Y10T 442/3114* (2015.04); *Y10T 442/3179* (2015.04); *Y10T 442/3195* (2015.04); *Y10T 442/3211* (2015.04)

(56) References Cited

U.S. PATENT DOCUMENTS

| | | | | |
|---|---|---|---|---|
| 4,740,409 | A * | 4/1988 | Lefkowitz | B01D 39/10 428/131 |
| 5,468,259 | A | 11/1995 | Sheth et al. | |
| 5,655,585 | A | 8/1997 | Fry | |
| 5,769,131 | A | 6/1998 | Whitlock et al. | |
| 5,927,222 | A | 7/1999 | Eakin et al. | |
| 6,769,535 | B2 | 8/2004 | Zilker et al. | |
| 7,132,376 | B2 | 11/2006 | Rashed | |
| 7,207,747 | B1 * | 4/2007 | England | E01C 13/02 210/170.01 |
| 7,465,129 | B2 | 12/2008 | Singleton | |
| 8,598,054 | B2 | 12/2013 | King et al. | |
| 2004/0171318 | A1 | 9/2004 | Rashed | |
| 2006/0240733 | A1 | 10/2006 | Bieser et al. | |
| 2007/0173162 | A1 | 7/2007 | Ethiopia | |
| 2007/0277897 | A1 | 12/2007 | King | |

FOREIGN PATENT DOCUMENTS

| | | | |
|---|---|---|---|
| EP | 0925394 | A1 | 6/1999 |
| WO | 2005111282 | A1 | 11/2005 |
| WO | 2007139593 | A1 | 12/2007 |

OTHER PUBLICATIONS

English Translation of Chinese Office Action dated Aug. 27, 2013 for Application No. 201180018382.5.
PCTUS2011032141_International Search Report dated Jun. 1, 2011.
Mirafi CCW402; TenCate Geosynthetics Americas; 1 page; 2013.
Mirafi HP370; TenCate Geosynthetics Americas; 1 page; 2012.
Mirafi HP570; TenCate Geosynthetics Americas; 1 page; 2013.
PCTUS2011032141_Written Opinion dated Jun. 1, 2011.

* cited by examiner

WOVEN GEOSYNTHETIC FABRIC

CROSS-REFERENCE TO RELATED APPLICATION

This application is a continuation of U.S. non-provisional patent application Ser. No. 13/085,293, filed on Apr. 12, 2011, and claims benefit of U.S. Provisional Patent Application Ser. No. 61/323,341, filed Apr. 12, 2010, both of which are incorporated herein in their entirety by reference.

FIELD OF THE INVENTION

The invention relates generally to woven geosynthetic fabrics. More specifically, the present invention is related to a double layer, single weave geotextile fabric having enhanced water flow, particle retention, and apparent opening size properties.

BACKGROUND OF THE INVENTION

Woven polypropylene geosynthetic fabrics are utilized to diminish the flow rate of water and maintain soil retention. Often such fabrics are used to establish a stable base for road ways. Thus, water flow through the fabric and soil retention by the fabric are important attributes. Moreover, the fabric should have sufficient tensile for durability, particularly when the fabric is subjected to loads.

However, water flow rate and soil retention are at odds with fabric strength. Typically, to increase strength, the pores of the fabric are reduced. As a result, the fabric is limited to the amount of water that can pass through the fabric and, as a result, the size of the soil particulates it can retain. If higher flow rates and larger particle size retention are desired, the fabric must yield on strength due to lower fabric density. Accordingly, there is a need for a woven geosynthetic fabric which has improved strength for durability while maintaining relatively high flow rates and particle retention. It is to solving this and other needs the present invention is directed.

SUMMARY OF THE INVENTION

The present invention is directed to a woven geosynthetic fabric comprising a double layer fabric formed from a single weave. The fabric comprises a first weft yarn, a second weft yarn, and a stuffer pick woven in the weft direction of the fabric, and a warp yarn interweaving the first and second weft yarns and the stuffer pick. The first weft yarn and the second weft yarn have different cross-sectional shapes. At least a portion of the fabric has a plurality of weft yarn sets having stuffer picks respectively disposed and woven between the weft yarn sets. Each weft yarn set has two first weft yarns and two second weft yarns. One of the two first weft yarns is adjacent one of the two second weft yarns and stacked on the other second weft yarn. The adjacent second weft yarn is stacked on the other first weft yarn. In addition, the fabric has ridges and valleys in the weft direction.

In one aspect, the first weft yarn is a high modulus tape comprising an admixture of polypropylene and a polypropylene/ethylene copolymer. In another aspect, the fabric has an AOS of at least 35 and water is capable of flowing through the fabric at a rate of at least 30 gallons/min.

DETAILED DESCRIPTION OF THE INVENTION

Figure 1:
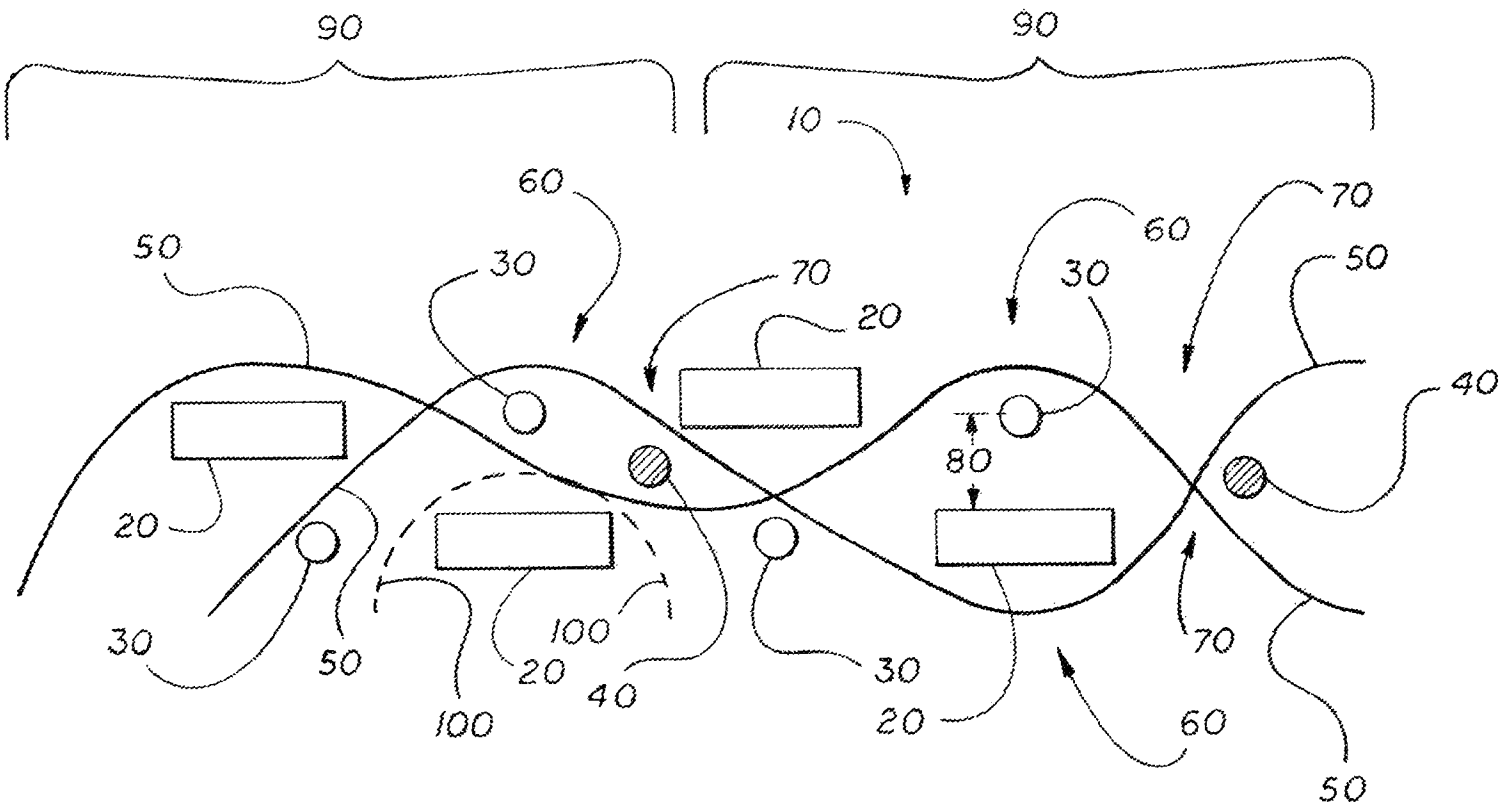
FIG. 1 is cross-sectional view of a woven geosynthetic fabric in accordance with the present invention.

FIG. 1 illustrates a woven fabric 10 in accordance with the present invention. The fabric 10 includes in the weft or fill direction a first weft yarn 20, a second weft yarn 30, and a stuffer pick 40. The first and second weft yarns 20, 30 and the stuffer pick 40 are interwoven with warp yarn 50. Because of the presence of the stuffer pick 40, ridges 60 and valleys 70 are formed on the respective surfaces of the fabric 10. In another aspect of the invention, yarns 20 and 30 and the stuffer pick 40 can be oriented in the warp direction and yarn 50 can be oriented in the weft direction. Fabrics made in accordance with the present invention can be employed for soil retention and/or stabilization. Uses of the inventive fabric include, but are not limited to, civil engineering projects, for example, such as a base liner for roadways, bridge bases, buildings, walls, and the like. Such applications are generally referred to as civil structures.

First weft yarns 20 and second weft yarn 30 comprise two types of yarns of differing geometrical cross-sectional shapes and are alternated across the fabric 10 in the warp direction as indicated in FIG. 1. First weft yarn 20 is a tape yarn having a rectilinear cross-section with a width greater than its thickness. Typically, first weft yarn 20 comprises a fibrillated tape of about 500 Denier to about 6000 Denier. In one aspect of the invention first weft yarn 20 comprises a fibrillated tape of about 1000 Denier to about 2900 Denier. In another aspect first weft yarn 20 comprises a fibrillated tape of about 1500 Denier. Also, in another aspect first weft yarn 20 comprises a fibrillated tape of about 1400 Denier. Yet, in another aspect first weft yarn 20 comprises a non-fibrillated tape of about 1000 Denier to about 2900 Denier. Still, in another aspect first weft yarn 20 comprises a non-fibrillated tape of about 1500 Denier. Second weft yarn 30 is a monofilament yarn having a different geometrically-shaped cross-section from that of the first weft yarn 20. In one aspect of the invention, second weft yarn 30 has a substantially rounded cross-sectional shape, such as a substantially circular cross-sectional shape as shown in FIG. 1. First weft yarns 20 are "stacked" on second weft yarns 30 and vice versa as illustrated. Further, second weft yarn 30 can be of any shape as long as a gap 80 is maintained between the first and second weft yarns 20, 30 at least at certain points along the fabric in the warp direction. Typically, the second weft yarn 30 is a monofilament yarn of about 400 Denier to about 1600 Denier.

As indicated in FIG. 1, the stuffer pick 40, which is shaded in the drawing for identification purposes only, is systematically woven into the fabric 10. Due to this systematic weaving pattern, the ridges 60 and valleys 70 are formed. In accordance with the present invention, at least a portion of the fabric 10 is woven across the fabric 10 in the warp direction by weft yarn sets 90. Each weft yarn set 90 comprises two first weft yarns 20 and two second weft yarns 30 for a total of four weft yarns per set. Each set comprises one first weft yarn 20 woven in a stacked formation over second weft yarn 30 followed second weft yarn 30 woven in a stacked formation over first weft yarn 20. Stuffer pick 40 is disposed and woven between respective weft yarn sets.

The first and second weft yarns 20, 30 and stuffer pick 40 are woven together with warp yarn 50. Warp yarn 50 comprises a 400 Denier to 1500 Denier monofilament yarn. In one aspect of the invention all yarns used in fabric 10 are made from synthetic polymers. In another aspect of the present invention the yarns are polypropylene and/or a blend of polypropylene. Yet, in another aspect the first weft yarn is a 1400 Denier fibrillated tape having a tenacity of at least 0.75 g/Denier at 1% strain, at least 1.5 g/Denier at 2% strain, and at least 3.75 g/Denier at 5% strain, and made of a composition comprising a melt blended admixture of polypropylene and a polypropylene/ethylene copolymer.

The yarn, monofilament, or tape comprising an admixture of polypropylene and a polypropylene/ethylene copolymer can comprise a polypropylene composition comprising a melt blended admixture of about 94 to about 95% by weight of polypropylene and about 5 to about 6% by weight of a polypropylene/ethylene copolymer. In another aspect, the yarn, monofilament, or tape can comprise an admixture of about 92% to about 95% by weight of polypropylene and about 5% to about 8% by weight of a polypropylene/ethylene copolymer. Further, in one aspect the polypropylene/ethylene copolymer has an ethylene content of about 5% to about 20% by weight of copolymer. In another aspect the polypropylene/ethylene copolymer has an ethylene content of about 8% to about 25%. Also, in another aspect, aspect the polypropylene/ethylene copolymer has an ethylene content of about 5% to about 17% by weight of copolymer. In yet another aspect, aspect the polypropylene/ethylene copolymer has an ethylene content of about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, or about 25%, or any range therebetween, by weight of copolymer. Still, in another aspect, the polypropylene/ethylene copolymer has an ethylene content of about 16% by weight of copolymer. Such admixture yarn is referred to herein as "high modulus" or "high mod" yarn. The high modulus yarn employed in fabric 10 is described in U.S. patent application Ser. No. 13/085,165 filed Apr. 12, 2011, which is incorporated herein by reference in its entirety. While the density of the fabric will depend on its intended properties and uses, the fabric 10 in the warp direction has a density of 20 to 50 threads/inch, and the fabric 10 in the fill or weft direction has a density of 15 to 40 threads/inch.

In one aspect of the present invention, the monofilament, yarn, tape, or staple fiber is made of a polypropylene composition comprising a melt blended admixture of about 94 to about 95% by weight of polypropylene and about 5 to about 6% by weight of the polypropylene/ethylene copolymer described above, and each has a tenacity of at least 0.6 g/Denier at 1% strain, 0.75 g/Denier at 1% strain, at least 1.5 g/Denier at 2% strain, and at least 3.75 g/Denier at 5% strain. In another aspect such monofilament, yarn, tape, or staple fiber, respectively, has a tenacity of at least 0.9 g/Denier at 1% strain, at least 1.75 g/Denier at 2% strain, and at least 4 g/Denier at 5% strain. Still, in another aspect such monofilament, yarn, tape, or staple fiber respectively has a tenacity of about 1 g/Denier at 1% strain, about 1.95 g/Denier at 2% strain, and about 4.6 g/Denier at 5% strain. Yet, in another aspect of such monofilament, yarn, tape, or staple fiber, respectively, has a tenacity of at least 0.6 g/Denier at 1% strain.

In another aspect of the present invention, the monofilament, yarn, tape, or staple fiber is made of a polypropylene composition comprising a melt blended admixture of about 93% by weight of polypropylene, about 5% by weight of a polypropylene/ethylene copolymer described above, and about 2 wt. % of an additive, and each has a tenacity of at least 0.75 g/Denier at 1% strain, at least 1.5 g/Denier at 2% strain, and at least 3.75 g/Denier at 5% strain. Yet, in another aspect such monofilament, yarn, tape, or staple fiber respectively has a tenacity of at least 0.9 g/Denier at 1% strain, at least 1.75 g/Denier at 2% strain, and at least 4 g/Denier at 5% strain. Still, in another aspect such monofilament, yarn, tape, or staple fiber respectively has a tenacity of about 1 g/Denier at 1% strain, about 1.95 g/Denier at 2% strain, and about 4.6 g/Denier at 5% strain. Yet still, in another aspect of such monofilament, yarn, tape, or staple fiber, respectively, has a tenacity of at least 0.6 g/Denier at 1% strain.

The resulting fabric 10 may be, but does not have to be, subjected to a calendaring process whereby the fabric 10 is subjected to heat and pressure (such as by running the fabric through a set of heated rollers) to compress and/or flatten the yarns and thereby reduce the overall thickness of fabric 10.

The fabric 10 provides open channels 100 through the fabric 10 for water flow. This is due to the different geometrical shapes of the first and second weft yarns 20, 30 forming the fabric 10. More specifically, the substantially circular shape and size of second weft yarns 30 ensure that gap 80 is maintained as previously discussed. Open channels 100 through which water can flow extend between adjacent first and second weft yarns 20, 30 and through the gap 80. With this fabric construction, water is able to flow at a rate between 5-175 gallons per square foot per minute through the fabric 10, as measured by ASTM standard D4491-99A. In another aspect water is able to flow at a rate between about 30 to about 150 gallons per square foot per minute through the fabric 10. Also, in another aspect water is able to flow at a rate between about 40 to about 150 gallons per square foot per minute through the fabric 10. Yet, in another aspect water is able to flow at a rate of at least 30 gallons, at least 35 gallons, at least 40 gallons, at least 45 gallons, at least 50 gallons, at least 55 gallons, at least 60 gallons, at least 65 gallons, at least 70 gallons, at least 75 gallons, at least 80 gallons, at least 90 gallons, at least 95 gallons, at least 100 gallons, at least 105 gallons, at least 110 gallons, at least 120 gallons, at least 125 gallons, at least 130 gallons, at least 135 gallons, at least 140 gallons, at least 145 gallons, or at least 150 gallons per square foot per minute through the fabric 10.

Figure 2:
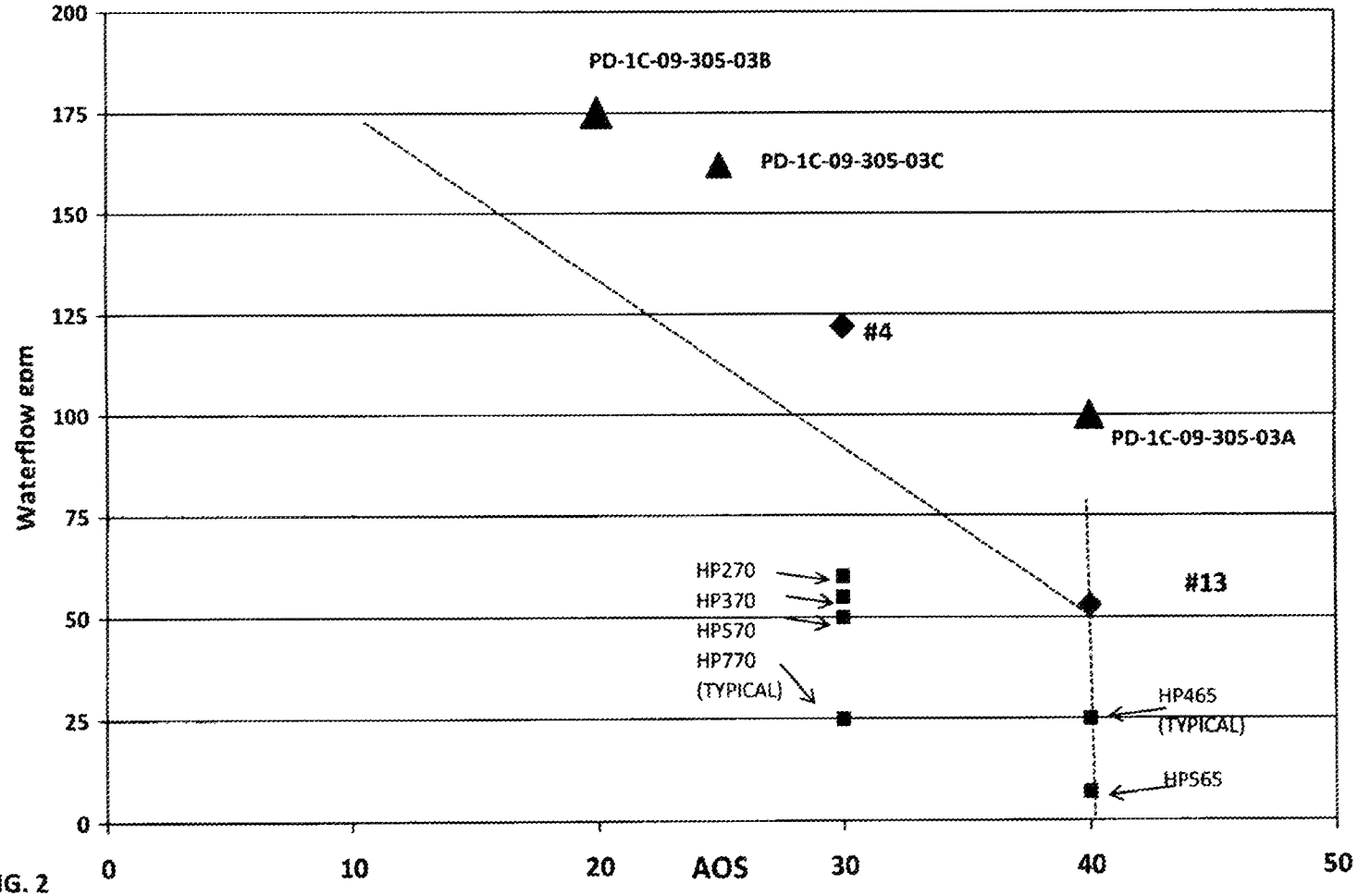
FIG. 2 is a plot comparing water flow rate and apparent opening size (AOS) of various woven fabrics.

FIG. 2 compares water flow rate through fabric and apparent opening size (AOS) of various woven fabrics. AOS was measured by ASTM D4751. #13 is an inventive fabric employing the high modulus polypropylene/polypropylene copolymer blend discussed above as the first weft yarn 20. This weft yarn was a 11.5 mil, 4600 Denier fibrillated tape. The second weft yarn, warp yarn, and stuffer pick were a 1400 Denier polypropylene monofilament. Fabric construction was 33×20 threads/in.

In one aspect the fabric 10 has an AOS of at least 35. In another aspect the fabric 10 has an AOS of at least 40. Yet, in another aspect, the fabric 10 has an AOS of at least 45.

Figure 3:
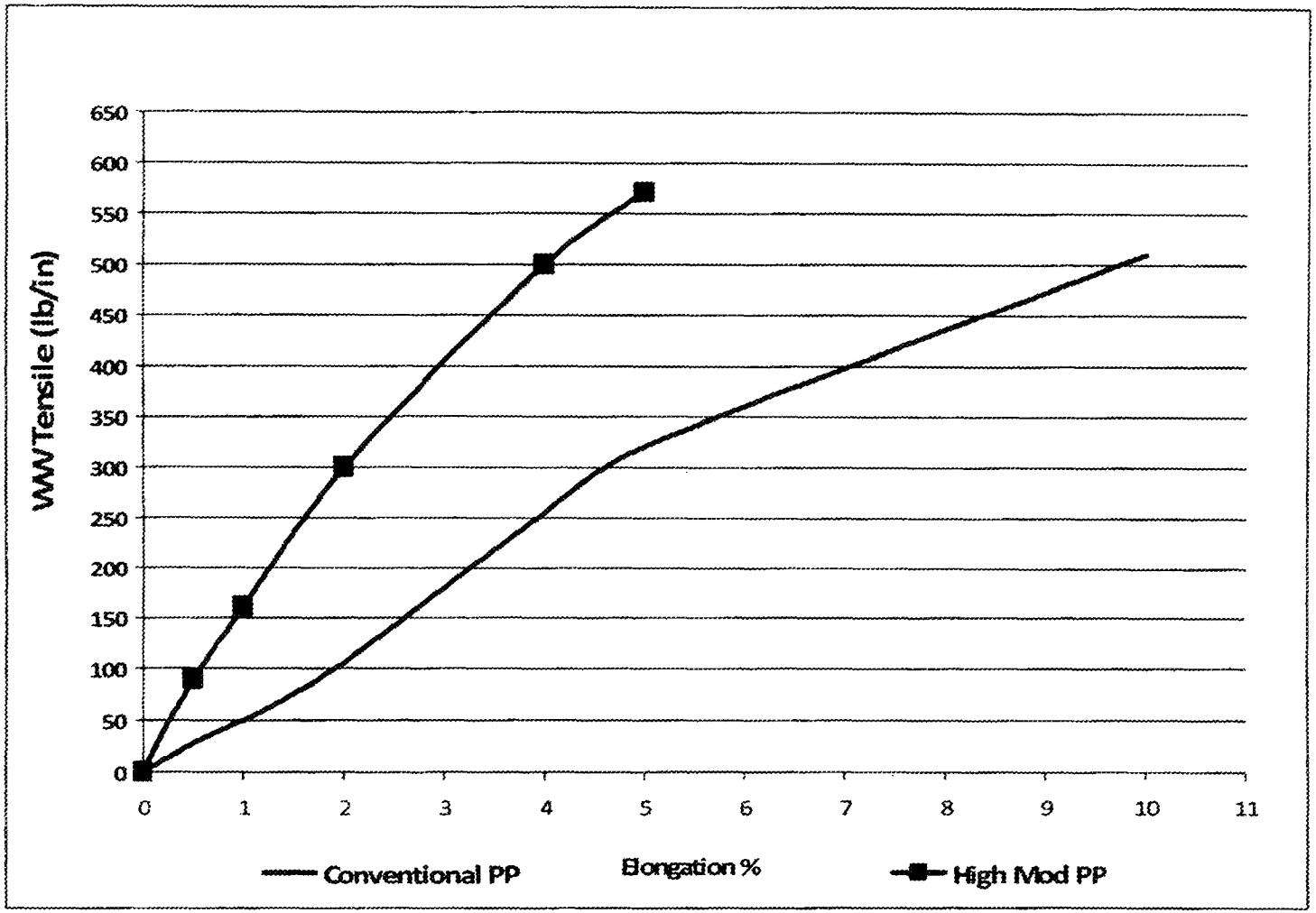
FIG. 3 is a tensile strength/elongation plot comparing a woven geosynthetic fabric of the present invention to a woven fabric made of polypropylene homopolymer.

FIG. 3 illustrates weft direction tensile strength of the inventive fabric using the polypropylene/polypropylene copolymer discussed immediately above. Tensile strength was measured in accordance with ASTM D4595. As shown in the plot, the fabric has a tensile strength in the weft direction of 90 lbs./in. at ½% strain, 160 lbs./in. at 1% strain, 300 lbs./in. at 2% strain, 500 lbs./in. at 4% strain, and 570 lbs./in. at 5% strain. Ultimate elongation in the weft direction is about 5%.

An inventive fabric, designated as RS580i, was compared to conventional polypropylene woven fabrics respectively designated HP370 and HP570. Table 1 provides the construction parameters of the respective fabrics.

TABLE 1

| Parameter | HP370 | HP570 | RS580i |
|---|---|---|---|
| Threads/inch, warp | 35 | 33 | 33 |
| Threads/inch, weft | 10.5 | 13 | 22 |
| Yarn Denier, warp | 1000 | 1360 | 1360 |
| Yarn Type*, warp | mono-filament PP | mono-filament PP | mono-filament PP |
| Yarn Denier, weft | 3000 | 4600 | 4600 & 565+ |
| Yarn Type, weft | fibrillated PP | fibrillated PP | fibrillated PP and mono-filament PP |
| Weight, ounces/yd. | 8.2 | 14.0 | 12.5 |
| Weave Pattern | 2 × 2 twill | 2 × 2 twill | double layer with stuffer pick (see FIG. 1) |

*PP = polypropylene
+Stuffer Pick

Figure 4:
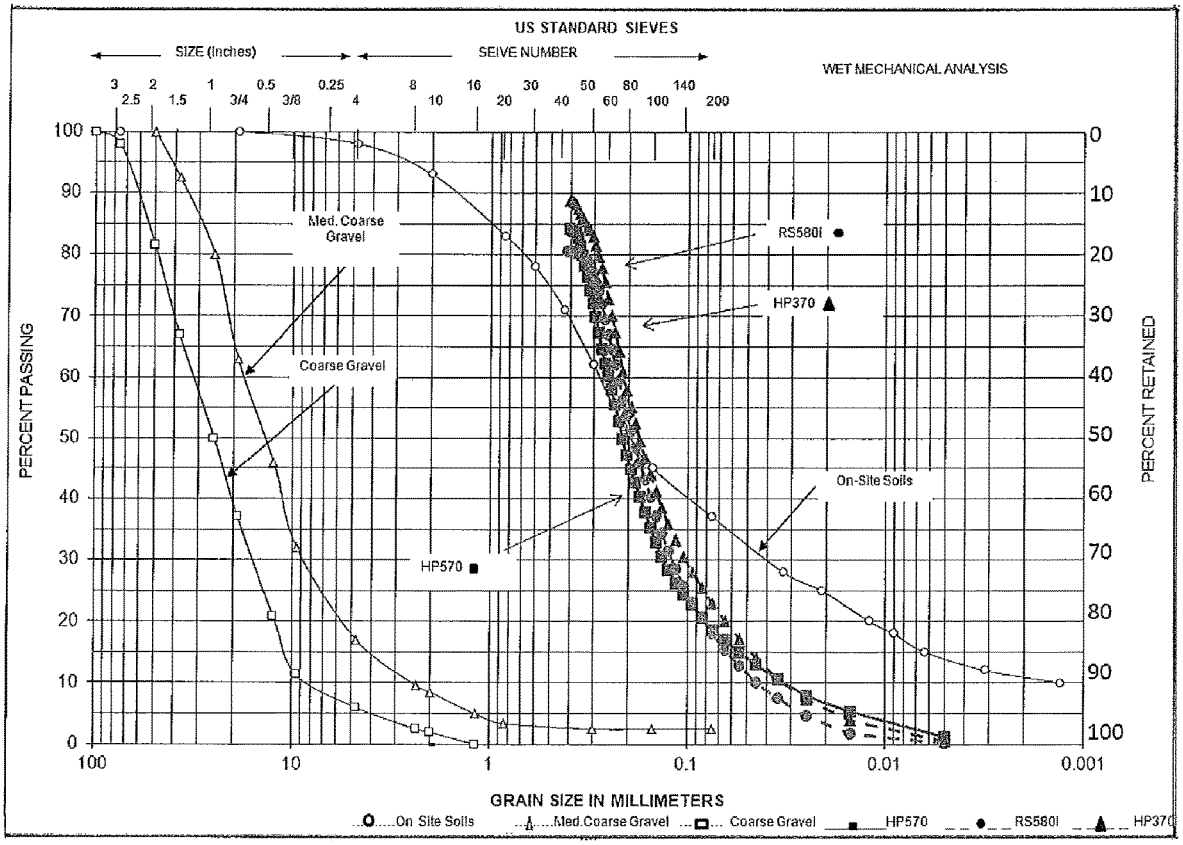
FIG. 4 is a grain size distribution graph comparing porosity with respect to various soil types of a woven geosynthetic fabric made in accordance with the present invention (RS580i) and two conventional fabrics.

FIG. 4 is a grain size distribution graph and aggregate grading chart for the HP370, HP570, and RS580i fabrics presented in Table 1. The graph provides porometer testing results with respect to various soil types. Specifically, this logarithmic graph shows cumulative percent passing of various particle sizes at various grain sizes, ranging from less than 0.01 millimeter (mm) to about 4 mm. As can be seen from the graph, while RS580i has larger pore openings than HP570, there are a fewer number of such larger openings as compared to HP370 and HP570.

Figure 5:
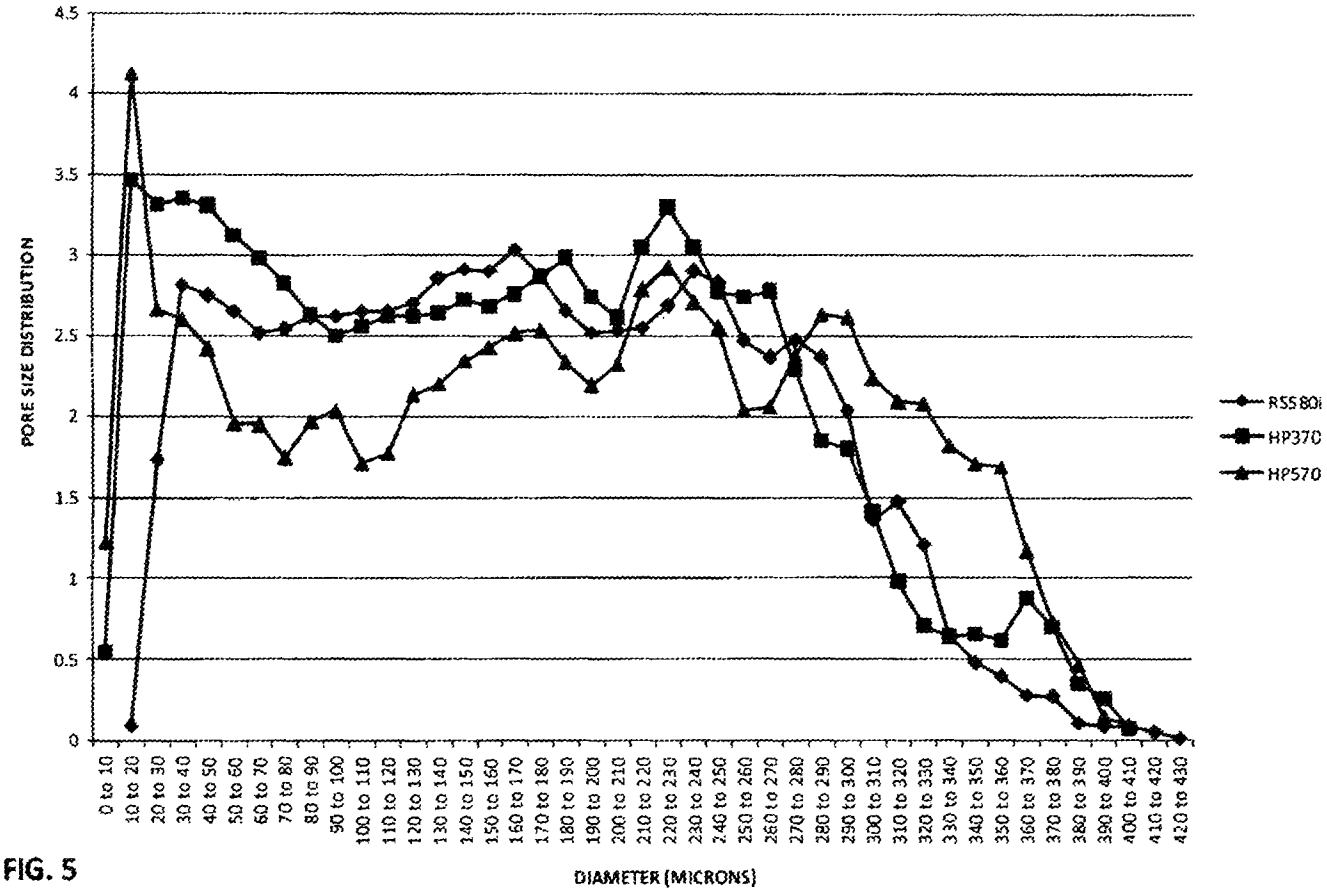
FIG. 5 is a plot comparing pore distribution to diameter of the fabrics of FIG. 4.

FIG. 5 compares pore distribution with respect to pore diameter of the HP370, HP570, and RS580i fabrics presented in Table 1. The pore test was performed in accordance with ASTM D6767, and the wetting material employed was a silicone oil having a surface tension of 20.1 dynes/centimeter sold under the name SILWICK SILICON FLUID by Porous Materials Inc., Ithaca, N.Y. As can be determined from FIG. 5, inventive fabric RS580i has a much larger number of smaller pores than HP570 for pore sizes less than 270 microns. At larger pore sizes, i.e., above 340 microns, HP570 has a larger number of such pores.

As can be see from FIGS. 2-5, the inventive fabric provides a higher overall flow rate with a higher number of smaller pores. Thus, the higher flow rate can be achieved without an increasing AOS, unlike the conventional fabrics. In addition, FIGS. 2-5 show that the inventive fabric has superior particle retention, higher tensile, and higher liquid flow than the conventional fabrics.

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims.

What is claimed is:

1. A woven geosynthetic fabric comprising:

a plurality of weft yarns forming a weft yarn set and a stuffer pick woven in the weft direction of the fabric, and a warp yarn interweaving the weft yarn set and the stuffer pick; and at least a portion of the fabric having a plurality of weft yarn sets having stuffer picks being respectively disposed and woven between the weft yarn sets, each weft yarn set having at least four weft yarns, each weft yarn of the weft yarn set positioned adjacent at least one of the weft yarns of the weft yarn set and stacked with another of weft yarn of the weft yarn set, and each weft yarn set being void of the stuffer pick, and at least one of the weft yarns having a tenacity of at least 0.6 g/denier at 1% strain.

2. A civil structure comprising the fabric of claim 1.

3. The civil structure of claim 2, wherein the civil structure is a roadway.

4. The civil structure of claim 2, wherein the civil structure is a wall.

5. The woven geosynthetic fabric of claim 1, wherein the woven geosynthetic fabric has an apparent opening size (AOS) of at least 35 as measured in accordance with American Society for Testing and Materials International (ASTM International) Standard D4751, a water flow rate of at least 30 gallons/minute·ft$^2$ (gpm/ft$^2$) as measured in accordance with ASTM International Standard D4491.

6. The woven geosynthetic fabric of claim 1, wherein the woven geosynthetic fabric has pores, and 50% of the pores are at least 90 microns in diameter, 60% are at least 220 microns in diameter, and 85% are at least 350 microns in diameter.

7. The woven geosynthetic fabric of claim 1, wherein the at least a portion of the fabric comprises a repeating pattern of the weft yarn sets having the stuffer picks respectively disposed and woven between the weft yarn sets.

8. A woven geosynthetic fabric comprising:

a first weft yarn, a second weft yarn, and a stuffer pick woven in the weft direction of the fabric, and a warp yarn interweaving the first and second weft yarns and the stuffer pick; and at least a portion of the fabric having a plurality of weft yarn sets having stuffer picks being respectively disposed and woven between the weft yarn sets, each weft yarn set having two first weft yarns and two second weft yarns, one of the two first weft yarns being adjacent one of the two second weft yarns and stacked on the other second weft yarn, the adjacent second weft yarn being stacked on the other first weft yarn, and each weft yarn set being void of a stuffer pick, and the first weft yarn having a tenacity of at least 0.75 g/denier at 1% strain, at least 1.5 g/denier at 2% strain, and at least 3.75 g/denier at 5% strain.

9. A civil structure comprising the fabric of claim 8.

10. The civil structure of claim 9, wherein the civil structure is a roadway.

11. The civil structure of claim 9, wherein the civil structure is a wall.

12. The woven geosynthetic fabric of claim 8, wherein the woven geosynthetic fabric has an AOS of at least 35 as measured in accordance with American Society for Testing and Materials International (ASTM International) Standard D4751, a water flow rate of at least 30 gpm/ft$^2$ as measured in accordance with ASTM International Standard D4491.

13. The woven geosynthetic fabric of claim 8, wherein the at least a portion of the fabric comprises a repeating pattern of the weft yarn sets having the stuffer picks respectively disposed and woven between the weft yarn sets.

14. A woven geosynthetic fabric comprising:

a first weft yarn, a second weft yarn, and a stuffer pick woven in the weft direction of the fabric, and a warp yarn interweaving the first and second weft yarns and the stuffer pick;

at least a portion of the fabric having a plurality of weft yarn sets having stuffer picks being respectively disposed and woven between the weft yarn sets, each weft yarn set having two first weft yarns and two second weft yarns, one of the two first weft yarns being adjacent one of the two second weft yarns and stacked on the other second weft yarn, the adjacent second weft yarn being stacked on the other first weft yarn, each weft yarn set being void of a stuffer pick, and the fabric having an AOS of at least 35 as measured in accordance with American Society for Testing and Materials International (ASTM International) Standard D4751 and having a water flow through the fabric of at least 30 gallons per square foot per minute as measured in accordance with ASTM International Standard D4491.

15. A civil structure comprising the fabric of claim 14.

16. The civil structure of claim 15, wherein the civil structure is a roadway.

17. The civil structure of claim 15, wherein the civil structure is a wall.

18. The woven geosynthetic fabric of claim 14, wherein the woven geosynthetic fabric has pores, and 50% of the pores are at least 90 microns in diameter, 60% are at least 220 microns in diameter, and 85% are at least 350 microns in diameter.

19. The woven geosynthetic fabric of claim 14, wherein the at least a portion of the fabric comprises a repeating pattern of the weft yarn sets having the stuffer picks respectively disposed and woven between the weft yarn sets.

* * * * *